US007762172B2

(12) United States Patent
Li et al.

(10) Patent No.: US 7,762,172 B2
(45) Date of Patent: Jul. 27, 2010

(54) WIRELESS PERFORATING GUN

(75) Inventors: Haoming Li, Missouri City, TX (US); Zheng Rong Xu, Sugar Land, TX (US); Chantal Smitheman, Pearland, TX (US); Cesar Gama, Maringa (BR); Alfredo Fayard, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 758 days.

(21) Appl. No.: 11/466,505

(22) Filed: Aug. 23, 2006

(65) Prior Publication Data

US 2008/0047456 A1 Feb. 28, 2008

(51) Int. Cl.
*E21B 43/116* (2006.01)
*E21B 43/117* (2006.01)

(52) U.S. Cl. ..... 89/1.15; 89/1.151

(58) Field of Classification Search ..... 89/1.15, 89/1.151; 102/202.5, 202.12, 206, 303, 310, 102/331

See application file for complete search history.

(56) References Cited

U.S. PATENT DOCUMENTS

| | | | | |
|---|---|---|---|---|
| 2,317,238 A | | 4/1943 | Mennecier | |
| 2,947,251 A | * | 8/1960 | Jilly | 175/4.6 |
| 3,685,448 A | | 8/1972 | Magneville | |
| 4,285,153 A | * | 8/1981 | Crouch | 42/84 |
| 5,060,573 A | | 10/1991 | Montgomery et al. | |
| 5,160,801 A | * | 11/1992 | Andersen et al. | 89/6 |
| 5,347,929 A | | 9/1994 | Lerche et al. | |
| 5,505,134 A | * | 4/1996 | Brooks et al. | 102/202.7 |
| 6,283,227 B1 | * | 9/2001 | Lerche et al. | 175/4.55 |
| 6,386,108 B1 | * | 5/2002 | Brooks et al. | 102/217 |
| 6,837,310 B2 | | 1/2005 | Martin | |
| 2005/0178282 A1 | | 8/2005 | Brooks | |
| 2005/0247450 A1 | | 11/2005 | Ratanasirigulchai et al. | |
| 2006/0124311 A1 | | 6/2006 | Lopez de Cardenas | |

FOREIGN PATENT DOCUMENTS

| | | |
|---|---|---|
| GB | 2290855 A | 1/1996 |
| GB | 2384140 A | 7/2003 |
| GB | 2406870 A | 4/2005 |

* cited by examiner

*Primary Examiner*—Bret Hayes
(74) *Attorney, Agent, or Firm*—Trop, Pruner & Hu, P.C.; Kevin B. McGoff; Rodney V. Warfford

(57) ABSTRACT

A loading tube for installation in the body of a perforating gun is disclosed. The loading tube holds a plurality of shaped charges whose detonation is electrically initiated, and the loading tube, when installed in the body, comprises at least a portion of the electrical circuit used to initiate detonation the shaped charge. In one embodiment, the loading tube comprises the hot portion of the electrical circuit, the body comprises the ground portion of the electrical circuit and the loading tube and the body are insulated from one another. Alternatively, the loading tube may comprise two distinct portions of conductive material which are electrically isolated from one another where the two portions of conductive material comprise the hot and ground portions of the electrical circuit. Additionally, a loading tube according to the present invention may comprise a conductor which is disposed in the loading tube near the outer surface of the loading tube and which is insulated from the loading tube. A system is disclosed comprising a loading tube having the aforesaid characteristics and a method is provided which utilizes the loading tube as a portion of the electrical circuit to initiate detonation of the charges.

23 Claims, 4 Drawing Sheets

WIRELESS PERFORATING GUN

BACKGROUND OF THE INVENTION

1. Field of the Invention

The present invention relates to method and apparatus for performing perforating operations, and, more particularly, to performing wireless perforating gun operations.

2. Description of the Prior Art

For purposes of enhancing production from a subterranean formation, a perforating gun typically is lowered down into a wellbore that extends through the formation. A perforating gun comprises a plurality of radially-oriented shaped charges which are detonated to penetrate and form perforations through the casing and cement into the formation proximate the wellbore. The shaped charges typically are distributed at points along a helical spiral that extends around the longitudinal axis of the perforating gun.

In wireline guns, there are normally two wires that run the length of the gun string. One of these wires is a live or hot wire which is connected to a positive or negative voltage, and the other wire is a ground wire. These wires are needed to connect a source of current and voltage which is located at or near the earth's surface to the electrical detonator in the body of the perforating gun. The electrical detonator is the apparatus that initiates the ballistic train including the detonating cord and subsequently the shaped charges which will perforate the well and permit flow between the reservoir in the formation and the wellbore. In some cases, the gun body has been used as the ground wire.

It frequently occurs that the live wire gets pinched during loading or transportation or even after arming of the perforating gun. The live wire may become an open circuit as a result of being pinched or may be shorted to ground which results in the hot wire no longer maintaining isolation from the ground. In either event, current and voltage never reach the detonator.

The presence of the wires decreases the amount of space in the gun for shaped charges and hence decreases the size of shaped charges which may be employed. The presence of the wires also increases the amount of time required to load a gun, and if a cable gets pinched or shorts out during the loading or transporting process, the wires must be replaced and reinstalled in the gun, which increases the time necessary for loading. The problems with the wires that are used in activating the electrical detonators are believed to contribute significantly to quality issues with respect to wireline perforating services.

SUMMARY OF THE INVENTION

In accordance with the present invention, a loading tube is provided for installation in the body of a perforating gun, where the loading tube holds a plurality of shaped charges, the detonation of which is electrically initiated. When installed in the body of the gun, the loading tube comprises at least a portion of the electrical circuit used to initiate the detonation of the shaped charges. In one embodiment, the loading tube comprises the hot portion of the electrical circuit, the body comprises the ground portion of the electrical circuit, and the loading tube and body are insulated from one another.

Insulation of the loading tube from the body may be effected in a number of ways. In one embodiment, the outer diameter of the loading tube may have a coating applied to it to insulate it from the body, while in another embodiment the inner diameter of the body may be coated to insulate it from the loading tube. In yet another embodiment, both the outer diameter of the loading tube and the inner diameter of the body may be coated with the insulating material.

Insulation of the loading tube from the body may also be effected by applying an insulating material to the loading tube. This insulating material may, for example, be a shrink wrap type material or an adhesive tape type material. Alternatively, the insulating material may comprise in-situ cured polymer tape or composite tape. These latter types of tapes may be wrapped onto the loading tube and then be cured under heat to become an integrated part of the loading tube. These tapes may be thermoset or thermoplastic polymers and/or their composites. Alternatively, sleeves of these in-situ cured insulating polymers and/or their composites may be slid onto the loading tube.

In a further embodiment of the present invention, insulating stand-offs are installed in the loading tube to insulate it from the body when the loading tube is placed within the body.

In yet another embodiment of the present invention, the loading tube comprises two pieces of conductive material. These pieces of conductive material are electrically isolated from one another and form the hot and ground portions of the electrical circuit.

In yet another embodiment of the present invention, the loading tube comprises a conductor which is disposed in the structure of the loading tube near the outer surface of the loading tube. This conductor forms a portion of the electrical circuit which is used to initiate the detonation of shaped charges and the detonating cord. This conductor is insulated from the loading tube, which forms another portion of the electrical circuit.

In accordance with the present invention, a perforating gun system for use in perforating the formation material proximate a wellbore is provided. The system comprises at least one perforating gun section comprising a body. A system in accordance with the present invention also comprises a plurality of radially oriented shaped charges whose detonation is electrically initiated and which when detonated produce jets to penetrate the formation material proximate the wellbore. A system in accordance with the present invention further comprises a loading tube which is installed in the body and which holds the shaped charges and the detonating cord. In a system according to the present invention, the loading tube comprises at least a portion of the circuit used to electrically initiate the detonation of the charges, and the loading tube may comprise any of the configurations described above for a loading tube.

In accordance with the present invention, a method is provided for establishing an electrical circuit in a perforating gun which electrical circuit is used to initiate the detonation of a plurality of shaped charges that are held in a loading tube in the body of the gun. A method in accordance with the present invention comprises the step of connecting the loading tube to the source of electricity used to initiate the detonation of the charges and passing electricity through the loading tube to initiate detonation of the charges. In one embodiment of the method of the present invention, the loading tube is used as the hot portion of the electrical circuit.

DESCRIPTION OF THE SPECIFIC EMBODIMENTS

It will be appreciated that the present invention may take many forms and embodiments. In the following description, some embodiments of the invention are described and numerous details are set forth to provide an understanding of the present invention. Those skilled in the art will appreciate, however, that the present invention practiced without those details and that numerous variations from and modifications of the described embodiments may be possible. The following description is thus intended to illustrate and not to limit the present invention.

While the following description may focus on the use of a apparatus according to the present invention in a wireline perforating system, those skilled in the art will appreciate that the such apparatus may also be utilized in other types of perforating systems when selective firing of the perforating guns in the string of perforating guns is desired. The applicants intend, therefore, that the appended claims, unless expressly limited to a wireline perforating system, should be interpreted so as to cover the invention when used in any type of perforating system In the following description, the shaped charges are sometimes referred to as being "radially-oriented." The radial orientation of the shaped charges is with respect to the longitudinal axis of the perforating gun.

Figure 1:
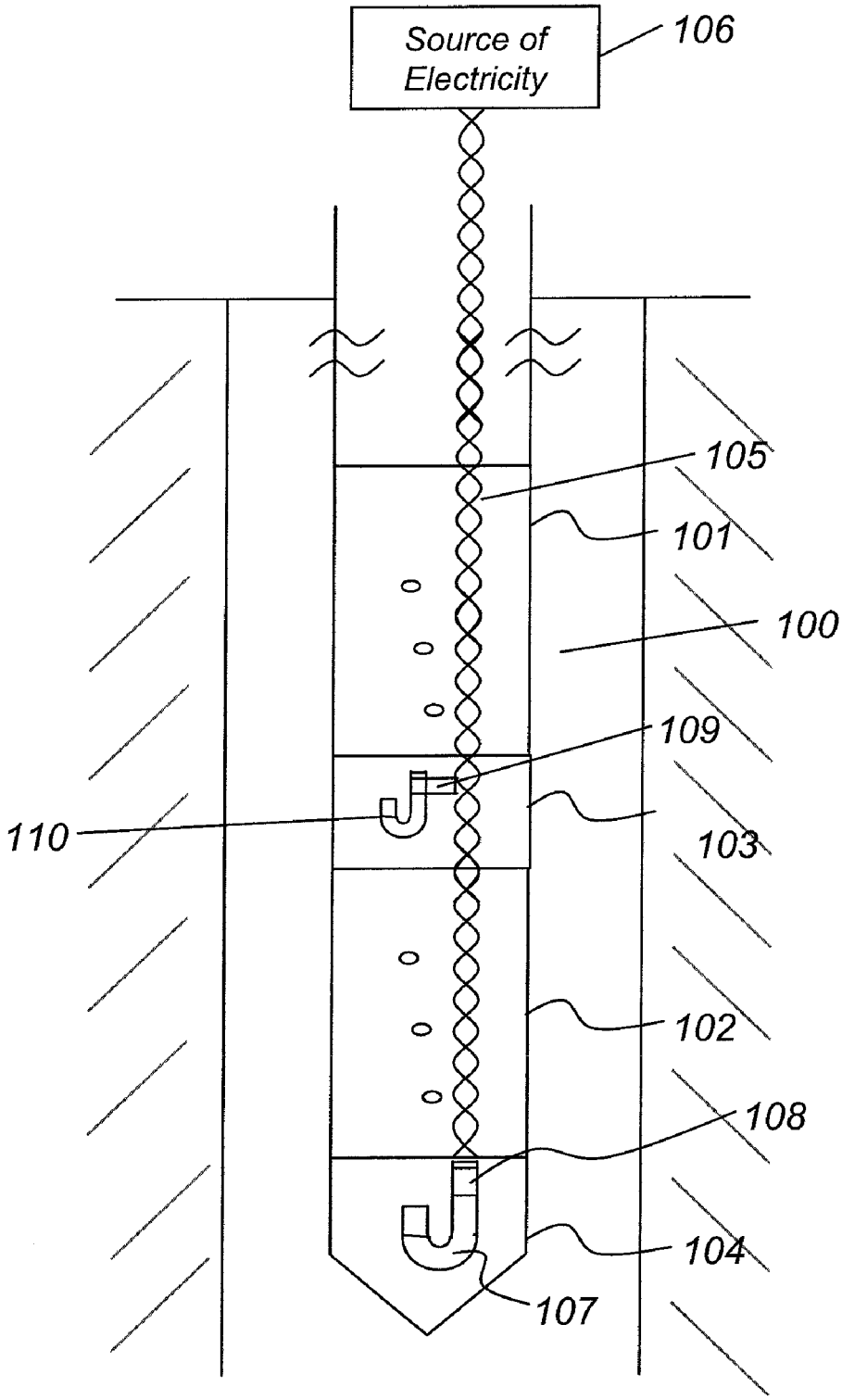
FIG. 1 is a pictorial drawing illustrating a typical wireline perforating gun system according to the prior art.

With reference first to FIG. 1, there is illustrated a wireline perforating gun system 100 according to the prior art which comprises a plurality of perforating gun sections 101 and 102. Interposed between perforating gun sections 101 and 102 is adapter 103. Connected to the lower end of perforating gun 102 is lower adapter 104, which sometimes is referred to as a "bottom nose."

Wireline perforating gun system 100 also includes a pair of wires 105 which runs the length of the perforating gun sections 101 and 102. One end of the pair of wires 105 is connected to a source of electricity 106 which is located at or near the earth's surface. The other end of the pair of wires 105 is connected to switch 108 which is in turn connected to detonator 107 in the lower adapter 104. The pair of wires 105 is also connected to a switch 109 and a detonator 110 in adapter 103. It is well known to those skilled in the art that the perforating guns in a wireline perforating system may be fired selectively, starting with the bottom-most gun. The firing of perforating guns 102 in the system of FIG. 1 may be effected by applying electricity from source 106 to the pair of wires which selects the switch 108 in adapter module 110 which in turn activates detonator 107. Switch 109 in adapter 103 is then selected which allows the detonator 106 to be activated and thereby allow the guns in perforating gun 101 to be detonated.

Figure 2:
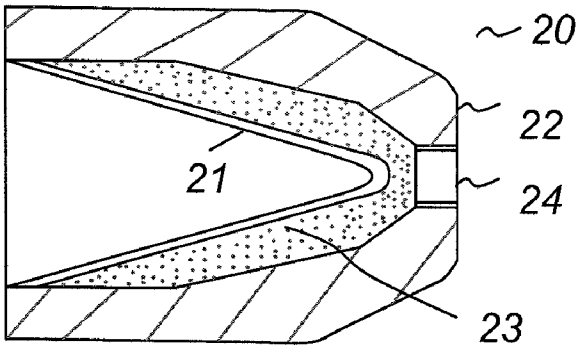
FIG. 2 is a cross-sectional view of a shaped charge that may be utilized in the perforating gun system of FIG. 1.
Figure 3:
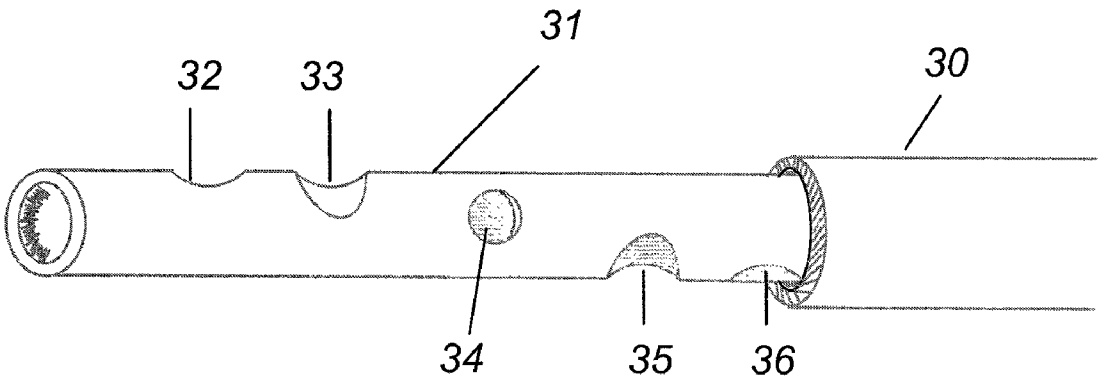
FIG. 3 is a perspective drawing of a loading tube in accordance with the present invention which is partially inserted in a perforating gun body.

With reference now to FIG. 3, loading tube 31 in accordance with the present invention is illustrated. Loading tube 31 is for installation in perforating gun body 30, which is sometimes referred to as a "carrier." Loading tube 31 holds a plurality of shaped charges which are distributed at locations 32-36 around the longitudinal axis of loading tube 31. In one embodiment, the locations 32-36 may be distributed along a helical path that extends around the longitudinal axis of loading tube 31. The shaped charges may, for example, have the configuration 20 as illustrated in FIG. 2 where each shaped charge includes: (i) a metal liner 21; (ii) a metal case 22; (iii) a main body of high explosive material 23 disposed between the metal liner 21 and the metal case 22; and (iv) an apex 24 which is adapted to receive a detonation cord (not shown).

A loading tube 31 in accordance with the present invention, when installed in gun body 30, comprises at least a portion of the electrical circuit used to initiate detonation of the shaped charges. In one embodiment, the loading tube 31 comprises the hot portion of that electrical circuit and the gun body 30 comprises the ground portion of that electrical circuit. In this embodiment, the loading tube 31 and the body 30 are insulated from one another and that insulation may be implemented in several ways.

One way to insulate loading tube 31 from gun body 30 is to coat the outer diameter of loading tube 31 with an insulating material, while another way to effect such insulation to coat the inner diameter of the body 30 with insulating material. If desired, both the inner diameter of body 30 and the outer diameter of loading tube 31 may be coated with insulating material. Examples of suitable coating materials include non-metallic paint, non-metallic epoxy paint and insulating coatings applied through an oven baking or dipping process.

Yet another way to insulate the loading tube 31 from the gun body 30 is to wrap the loading tube with an insulating material, such as shrink wrap type material or self-adhesive tape. Suitable shrink wrap type material may be obtained through several suppliers, and, as known in the prior art, the shrink wrap material would be applied to the loading tube using techniques such as heat, light or exposure to gases. Utilization of shrink wrap material will, of course, require that the profiles on the loading tube, e.g., the locations where the shaped charges will be installed, be cut out after the shrink wrap material is applied to loading tube 31. Suitable self-adhesive tape is believed to be available from a number of suppliers.

Alternatively, the insulating material may comprise in-situ cured polymer tape or composite tape. These types of tapes may be wrapped onto the loading tube and then be cured under heat to become an integrated part of the loading tube. These tapes may be thermoset or thermoplastic polymers and/or their composites, and can be made in a very thin layer. Additionally, sleeves made of these in-situ cured polymers as their composites may be slid onto the loading tube 31.

Figure 4:
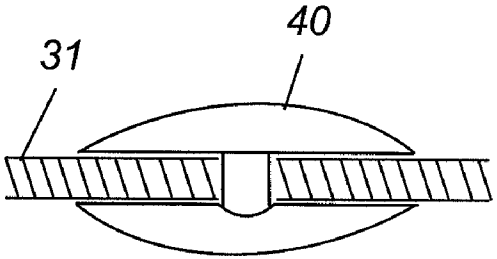
FIG. 4 is a perspective view of one type of an assembled insulating standoff which may be utilized with the loading tube illustrated in FIG. 3.

Yet a further way to insulate loading tube 31 from body 30 is illustrated in FIG. 4. In FIG. 4, insulating stand-offs 40 may be attached to loading tube 31 at a plurality of locations. Insulating standoffs 40 may, for example, be made of suitable non-conductive material, such as Teflon. Each such stand-off may, prior to installation, be in two parts which may engage each other when installed in loading tube 31. Alternatively, each standoff may comprise a single piece of insulating material.

Figure 5:
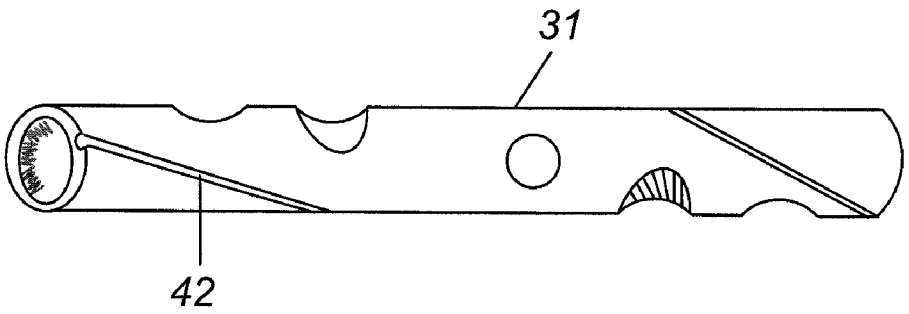
FIG. 5 is a perspective view of a loading tube in accordance with another embodiment of the present invention.
Figure 6:
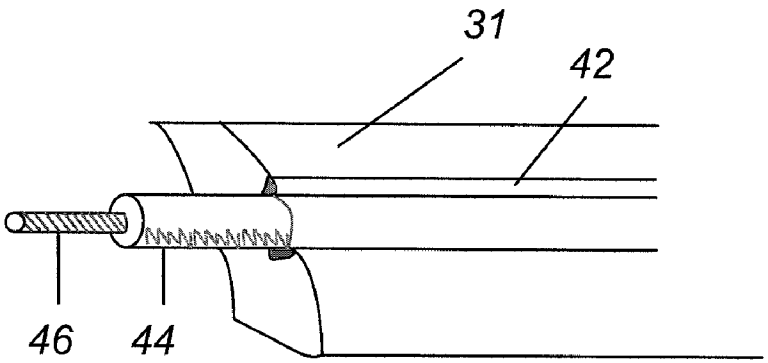
FIG. 6 is a partial perspective view of the loading tube of FIG. 5 which illustrates a conductor being inserted into the groove 42 of FIG. 5.

With reference now to FIGS. 5 and 6, another embodiment of a loading tube in accordance with the present invention is illustrated. In this embodiment, a recess 42 is formed in loading tube 31. An insulated conductor 44 is then installed in recess 42. In this embodiment, the conductor portion 46 of insulated conductor 44 may comprise one portion of electrical circuit used to initiate detonation and the loading tube 31 may comprise the second portion of that electrical circuit.

Figure 7:
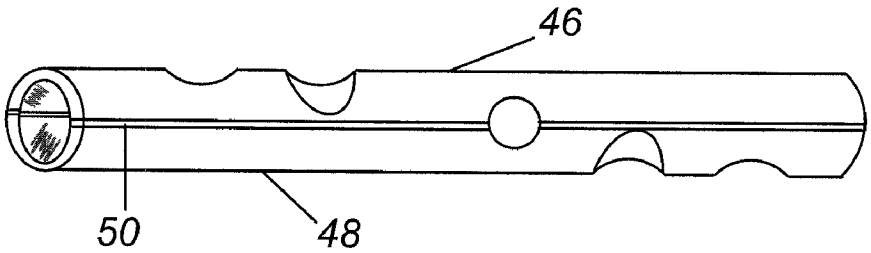
FIG. 7 is a perspective view of another embodiment of a loading tube in accordance with the present invention.
Figure 8:
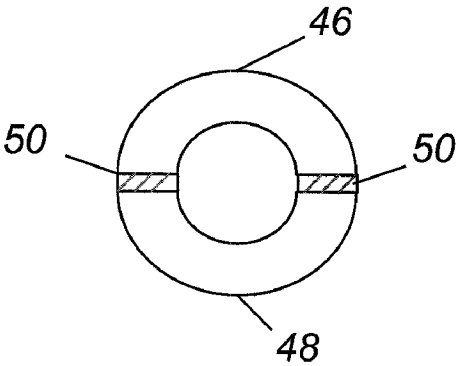
FIG. 8 is a cross-sectional view taken along the line 8-8' in FIG. 7.

Referring to FIGS. 7 and 8, another embodiment of a loading tube 47 in accordance with the present invention is illustrated. Loading tube 47 comprises two pieces of conducting material 46 and 48. An insulating material 50 is interposed between the longitudinal edges of conductive pieces 46 and 48. Insulating material 50 may, in addition to providing insulation between conductive pieces 46 and 48, serve to form a structural bond between them. In this embodiment, one conductive piece, e.g., 46, is connected to the hot portion of the electrical circuit used to initiate detonation and the other conductive piece, e.g., 48, is connected to the ground side of that electrical circuit.

A system according to the present invention comprises at least one perforating gun section where each perforating gun section comprises a loading tube having any of the alternative characteristics described above.

What is claimed is:

1. An apparatus comprising a loading tube and a body of a perforating gun, the loading tube containing a plurality of shaped charges that are electrically initiated, said loading tube installed in said body and forming at least a portion of an electrical circuit used to initiate detonation of said shaped charges, wherein the loading tube is a hot portion of said electrical circuit, the body is a ground portion of said electrical circuit, and the loading tube is insulated from the body.

2. The apparatus of claim 1, wherein the loading tube has a coating applied to the loading tube to insulate the loading tube from the body.

3. The apparatus of claim 1, wherein the loading tube is wrapped with an insulating material to insulate the loading tube from the body.

4. The apparatus of claim 3, wherein the insulating material is a shrink wrap material.

5. The apparatus of claim 3, wherein the insulating material is at least one selected from the following: self-adhesive tape, insulating polymer tape, composite tape, polymer sleeve, and composite sleeve.

6. The apparatus of claim 1, wherein the loading tube comprises two pieces of conductive material, wherein the two pieces of conductive material are electrically isolated from one another, and wherein the two pieces of conductive material are part of the hot portion and ground portion, respectively, of said electrical circuit.

7. The apparatus of claim 1, comprising a conductor disposed in a recess formed in the loading tube near an outer surface of the loading tube, wherein the conductor is insulated from the loading tube, said conductor forming a first portion of said electrical circuit and said loading tube forming a second portion of said electrical circuit.

8. A perforating gun system for use in perforating a formation material proximate a wellbore, the perforating gun system comprising at least one perforating gun section, where said perforating gun section comprises:

a body;

a plurality of distributed shaped charges that are electrically initiated, the shaped charges, when detonated, producing jets that penetrate the formation material proximate the wellbore;

a loading tube installed in said body, the loading tube holding the shaped charges, said loading tube forming at least a portion of an electrical circuit used to electrically initiate detonation of said shaped charges.

9. The system of claim 8, wherein the loading tube comprises a hot portion of said electrical circuit, the body comprises a ground portion of said electrical circuit, and the loading tube and body are insulated from one another.

10. The system of claim 9, wherein the loading tube has an insulating coating applied to the loading tube to insulate the loading tube from the body.

11. The system of claim 10, wherein an inner diameter of the body is also coated with an insulating coating.

12. The system of claim 9, wherein an inner diameter of the body has a coating applied to the body to insulate the body from the loading tube.

13. The system of claim 9, wherein an insulating material is wrapped around the loading tube to insulate the loading tube from the body.

14. The system of claim 13, wherein the insulating material is at least one selected from the following: shrink wrap material and self adhesive tape.

15. The system of claim 13, wherein the insulating material is insulating polymer tape.

16. The system of claim 13, wherein the insulating material is composite tape.

17. The system of claim 13, wherein the loading tube is inserted into a sleeve of polymer material.

18. The system of claim 13, wherein the loading tube is inserted into a sleeve of composite material.

19. The system of claim 9, wherein insulating standoffs are installed in the loading tube to insulate the loading tube from the body.

20. The system of claim 9, wherein the loading tube comprises two pieces of conductive material that are electrically isolated from one another, wherein the two pieces of conductive material form a hot portion and ground portion, respectively, of said electrical circuit.

21. The system of claim 9, wherein the loading tube comprises a conductor that is disposed in a recess formed in the loading tube near an outer surface of the loading tube, wherein the conductor is insulated from the loading tube, said conductor forming a first portion of said electrical circuit and said loading tube forming a second portion of said electrical circuit.

22. A method of establishing an electrical circuit in a perforating gun, wherein the electrical circuit is used to initiate detonation of a plurality of shaped charges that are held in a loading tube in a body of the perforating gun, the method comprising:

connecting the loading tube to a source of electricity used to initiate detonation of the shaped charges; and passing electricity through a material of the loading tube to initiate detonation of the shaped charges, wherein the material of the loading tube forms a first portion of the electrical circuit.

23. The method of claim 22, wherein the loading tube is used as a hot portion of the electrical circuit.

* * * * *